United States Patent [19]

Valenzona

[11] Patent Number: 4,997,999

[45] Date of Patent: Mar. 5, 1991

[54] PULSE-TYPE SWITCHING APPARATUS AND METHOD OF OPERATION

[75] Inventor: Joseph Valenzona, La Mirada, Calif.

[73] Assignee: Judco Manufacturing, Incorporated, Harbor City, Calif.

[21] Appl. No.: 378,365

[22] Filed: Jul. 11, 1989

[51] Int. Cl.[5] ..... H01H 13/50

[52] U.S. Cl. ..... 200/510; 200/527; 200/536

[58] Field of Search ..... 200/510, 509, 527, 529, 200/533, 536

[56] References Cited

U.S. PATENT DOCUMENTS 775,055 11/1904 Waterman ..... 200/510

2,291,993 8/1942 Taubner ..... 200/510

*Primary Examiner*—Renee S. Luebke

*Attorney, Agent, or Firm*—Kenneth W. Float

[57] ABSTRACT

A miniature ratchet type push button activated electrical switch wherein a first electrical contact is caused to sweep across and briefly contact a second electrical contact upon depression of a push button to transmit an electrical pulse. The rotation is driven by the free expansion of a spring upon depression of the push button beyond a preselected depth, and therefore results in a pulse of uniform duration independent of how quickly the push button is depressed or how long it is held in its depressed state.

13 Claims, 3 Drawing Sheets

PULSE-TYPE SWITCHING APPARATUS AND METHOD OF OPERATION

BACKGROUND OF THE INVENTION

1. Field of the Invention

This invention relates to miniature switches for use in electrical and electronic circuits, and more particularly pertains to miniature push button switches that close an electrical circuit for only a very short period of time upon depression of the push button.

2. Description of the Related Art

In the field of electrical switch design it is often desirable to close a circuit for only a short transitory period of time. This has the effect of transmitting a pulse. Such a function is employed in latching electrical or electronic circuitry where a sustained ON condition is not warranted or could prove detrimental.

A pulsed signal has typically been produced in the past by combining a conventional switch, which simply closes a circuit, with electronic processing which serves to convert a continuous ON condition to a single short duration ON condition. This approach has the disadvantage in that the additional electronics add considerable complexity and cost to a system and depending on the switch design, contact bounce or voltage fluctuation of such an arrangement during the ON condition could yield multiple pulse signals.

SUMMARY OF THE INVENTION

Briefly and in general terms, the present invention provides a new and improved miniaturized push button switch construction and method which provides a single, short duration ON condition upon depression of the push button. Moreover, the switching action achieves a pulse of uniform duration regardless of the manner in which the push button is depressed. The switch employs a ratchet mechanism by which a depression of the push button is translated into a rotation of the first electrical contact which sweeps across a stationary second electrical contact during a switching cycle.

In accordance with a preferred embodiment of the invention, a known miniature push button ratchet switch design is modified such that one switching cycle results in 90° of rotation of the contact cup. A conductive ear, rigidly attached to the contact cup sweeps over a stationary second contact during that part of the switching cycle in which the actual rotation of the mechanism is driven by expanding coil springs previously compressed by depression of the push button. The dynamics of the expanding springs are independent from the dynamics of the depression of the push button, and consequently, a repeatable, transient and uniform ON condition is achieved.

These and other features and advantages of the invention will become apparent from the following more detailed description, when taken in conjunction with the accompanying drawings, which illustrate, by way of example, the features of the invention.

DETAILED DESCRIPTION OF THE PREFERRED EMBODIMENT

Figure 1:
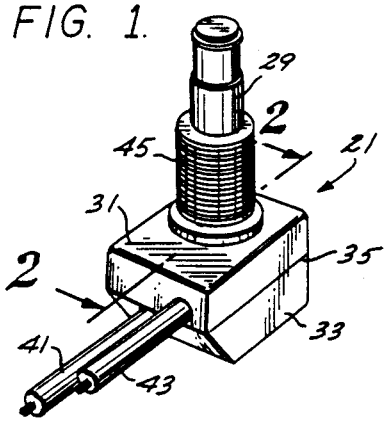
FIG. 1 is a perspective view of the pulse switch of the present invention.

As shown in the drawings, which are included for purposes of illustration, but not by way of limitation, the invention is embodied in a miniature ratchet switch 21 of the type having a main spring 23 for operating a ratchet mechanism. The mechanism serves to rotate a contact cup 25 having radially extending contact ears 71 which sweep across a stationary electrical contact 27 upon depression of a plunger 29.

In certain design situations, it may be required or desirable for an electrical switch to close a circuit for only a single, short period of time to generate in effect a pulse of current or voltage. A push button type switch offers a convenient means for manually controlling a switching operation while a ratchet mechanism offers a convenient means for converting the push of a button to the switching of electric circuitry.

Figure 2:
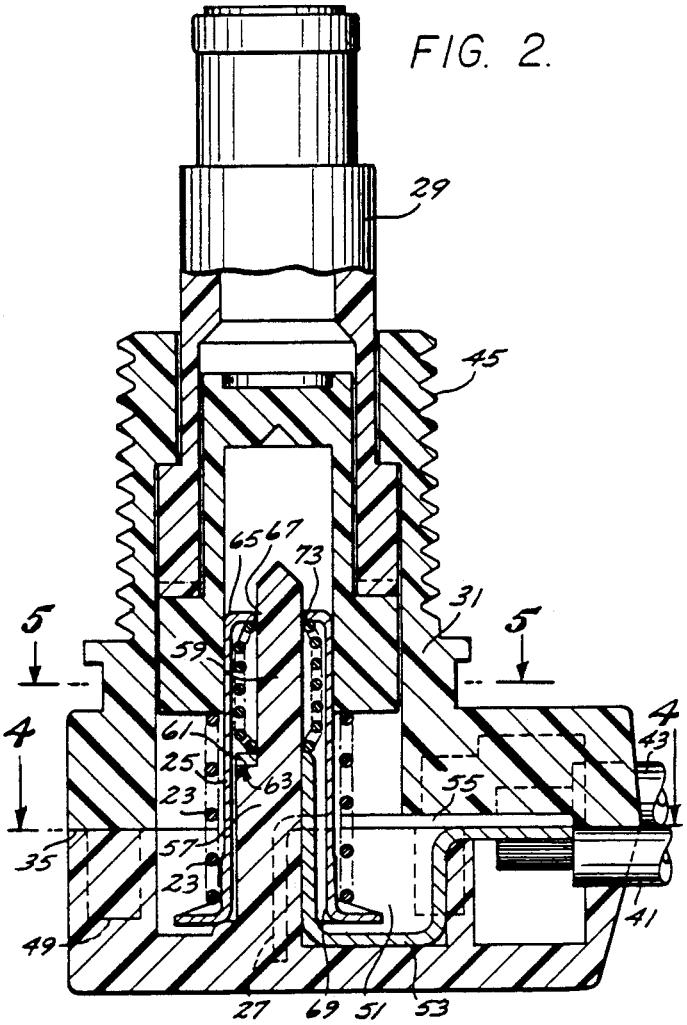
FIG. 2 is an enlarged cross-sectional view of the switch taken along the line 2—2 of FIG. 1.
Figure 3:
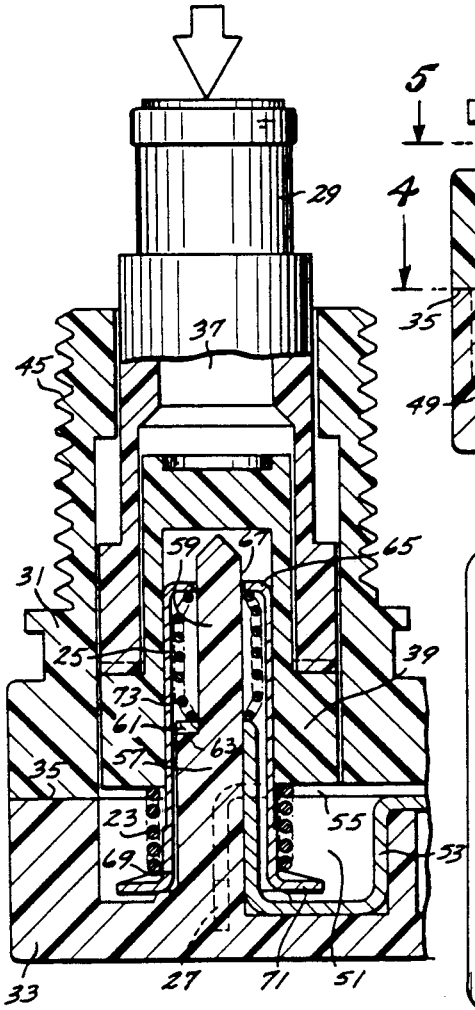
FIG. 3 is an enlarged cross-sectional view of the pulse switch of FIG. 2 in a depressed state.

In accordance with the present invention, a ratchet switch 21 is comprised of two major components, including a body portion 31 and cover portion 33 as is shown in FIGS. 1-3. The body portion 31 and the cover portion 33 are physically joined at an interface 35. The upper section of the body portion houses a depressible plunger 29 and has a threaded exterior 45 to facilitate the mounting of the switch 21 to a control panel. Two insulated electrical conductors, a first conductor 41 and a second conductor 43 are routed into the switch 21 through ports located directly adjacent to the interface 35 between the body portion 31 and the cover portion 33.

Figure 4:
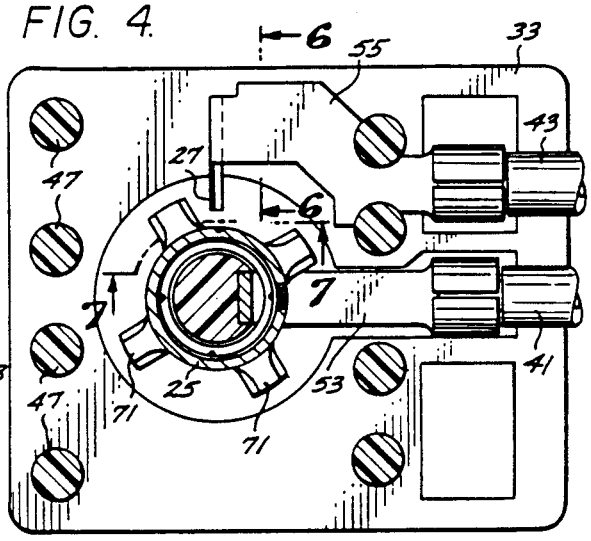
FIG. 4 is a cross-sectional view of the pulse ratchet switch of the present invention taken along line 4—4 of FIG. 2.

In the preferred embodiment illustrated, the body portion 31, including the vertically extending threaded 45 upper portion are of integrally molded unibody construction formed of insulating plastic. The cover portion 33 is similarly molded of insulating plastic. The body portion 31 is held securely to the cover portion 33 by a post and hole interference fit. A plurality of holes 47 are distributed about the cover portion 33 as is illustrated in FIG. 4. In addition, a plurality of posts 49 extending from the body portion are shown in phantom in FIG. 2 as seated within the plurality of holes 47 for securing the cover portion 33 to the body portion 31.

The cover portion 33 includes a centrally located well 51. A center post 57 rises from the well 51 of the cover portion 33. The center post is generally circular and accommodates an extension of electrical connector 53 along its vertical side.

The circumference of the top of the center post 57 narrows forming a cone head 59 for penetrating a mounting hole of ring portion 61 of electrical connector 53. The ring portion 61 is seated on a ledge 63 formed at the interface between the center post 57 and the cone head 59 with the remainder of the electrical connector 53 being fashioned to fit along side the center post 57 and along the bottom of centrally located well 51 of the cover portion 33 to interconnect with electrical conductor 41.

The second electrical connector 55, interconnected with electrical conductor 43, is routed along the interface 35 between the body portion 31 and the cover portion 33, down into the well 51 and finally is turned upwardly to form the stationary electrical contact 27. One conductor is connectable to a power source while the other conductor is connectable to a load.

Figure 7:
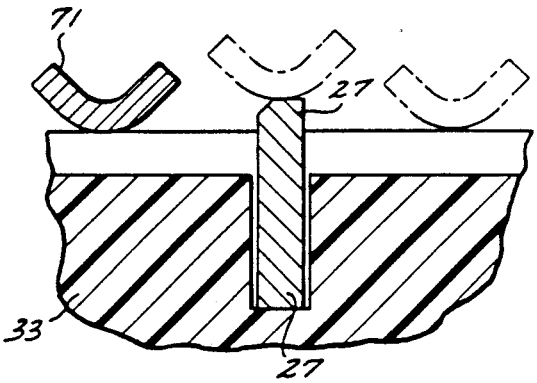
FIG. 7 is a further enlarged cross-sectional pulse switch of the present invention taken along line 7—7 of FIG. 4.
Figure 8:
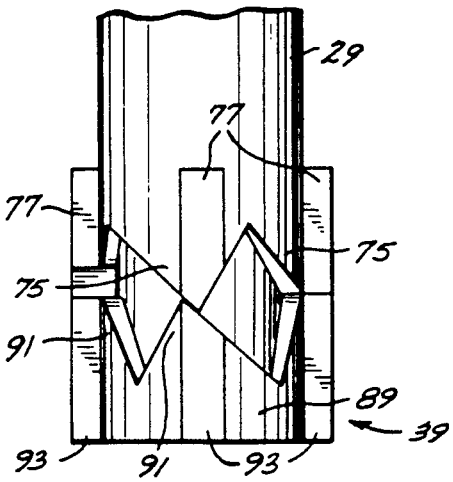
FIG. 8 is a side view of the plunger and ratchet sleeve of the present invention.
Figure 9:
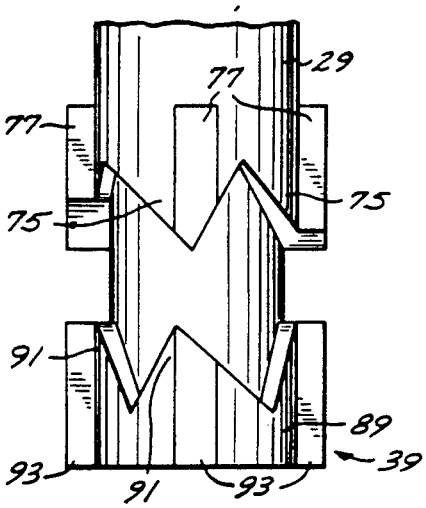
FIG. 9 is a side view of the plunger and ratchet sleeve of the present invention.

The contact cup 25 is metallic and is an integral part of the electrical conductive path as it serves to momentarily bridge the ring portion 61 of electrical connector 53 with contact 27 of the switch 21 during a switching cycle. The contact cup has the general form of a right circular cylinder. The first end 65 is formed with a curved surface having a small circular opening or hole 67 therethrough which accommodates the cone head 59. The second end 69 of the contact cup 25 is fully open and includes a plurality of extension ears 71 distributed in a quadrature spaced relationship to one another. Each extension ear 71 curved as illustrated in FIG. 7 and acts as the actual contact for engaging electrical contact 27. Electrical continuity is maintained between the ring portion 61 of connector 41 and the contact cup 25 by the conductor spring 73 held in compression within the contact cup 25 between the interior of the contact cup's partially closed first end 65 and the ledge 63 of the center post 57.

The ratchet mechanism which serves to convert depression of the plunger 29 to a rotation of the contact cup 25 relies on the cooperation and interaction of the lower part of the plunger 29, the interior of the upper threaded section of the body portion 31, the ratchet sleeve 39 and the main spring 23.

The plunger 29 is of cylindrical cross-section, is slidingly positioned within the upper section of the body portion 31 and substantially projects therefrom. The plunger is closed on its top end and open on its opposite end where it terminates in a plurality of downwardly extending serrated teeth 75 and a plurality of radially extending protuberances 77.

Figure 5:
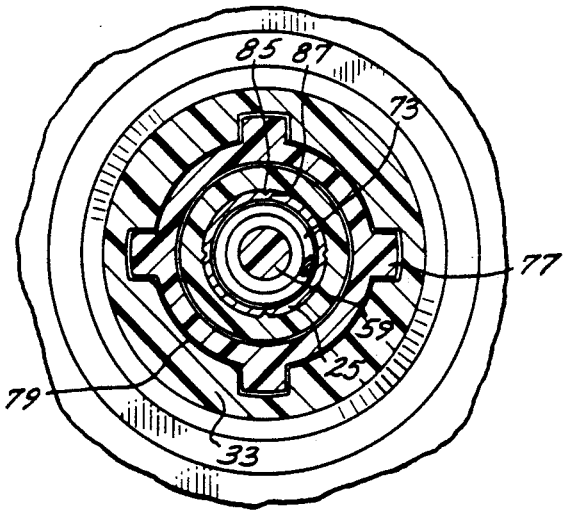
FIG. 5 is a cross-sectional view of the pulse switch of the present invention taken along line 5—5 of FIG. 2.
Figure 6:
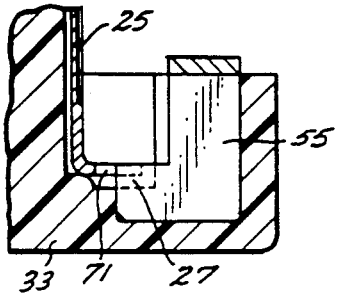
FIG. 6 is a further enlarged cross-sectional view of the present invention taken along line 6—6 of FIG. 4.

The interior of the upper threaded section of the body portion 31 includes a plurality of vertical splines 79 molded directly into the body portion's walls 81 as illustrated in FIG. 5. The splines 79 are distributed about the inner circumference at regular intervals with each spline 79 extending to approximately three-quarters of the height of the vertically extending upper section of the body portion 31. Each spline 79 has a ramp-shaped terminal end 83 which extends downwardly toward the cover portion 33.

The ratchet sleeve 39 is of cylindrical cross-section having a hollow interior for sliding over the contact cup 25 as shown in FIGS. 2, 3, 8 & 9. The interior of the ratchet sleeve 39 includes a plurality of vertical ribs 85 which are orthogonal to the inner wall of the ratchet sleeve 39 and arranged in a quadrature spaced relationship with one another. The ratchet sleeve 39 slides over the contact cup 25 with the plurality of vertical ribs 85 being slidingly received by a plurality of congruent vertical grooves 87 formed in the exterior of the contact cup 25. When the ratchet sleeve is caused to rotate, the contact cup 25 follows. The ratchet sleeve 39 further includes a ledge, 89 formed about the outer circumference of the ratchet sleeve 39, having a plurality of upwardly extending serrated teeth 91 and a plurality of protuberances 93 radially extending therefrom defining four quadrants.

The main spring 23 consists of a helically wound wire disposed about the exterior of the contact cup 25 in between the extension ears 71 and the bottom of the ratchet sleeve 39. This positioning of the main spring 23 biases both the ratchet sleeve 39 as well as the plunger 29 upwardly, their upward movement ultimately being limited by the plunger protuberances 77 reaching the end of the splines 79 within the upper section of the body portion 31.

As will become apparent hereinafter, an additional physical feature of the ratchet mechanism absolutely essential to its operation is the fact that the location of the plunger protuberances 77 relative to the plunger teeth 75 is angularly offset when compared to the location of the ratchet sleeve protuberances 93 relative to the ratchet sleeve teeth 91.

Figure 10:
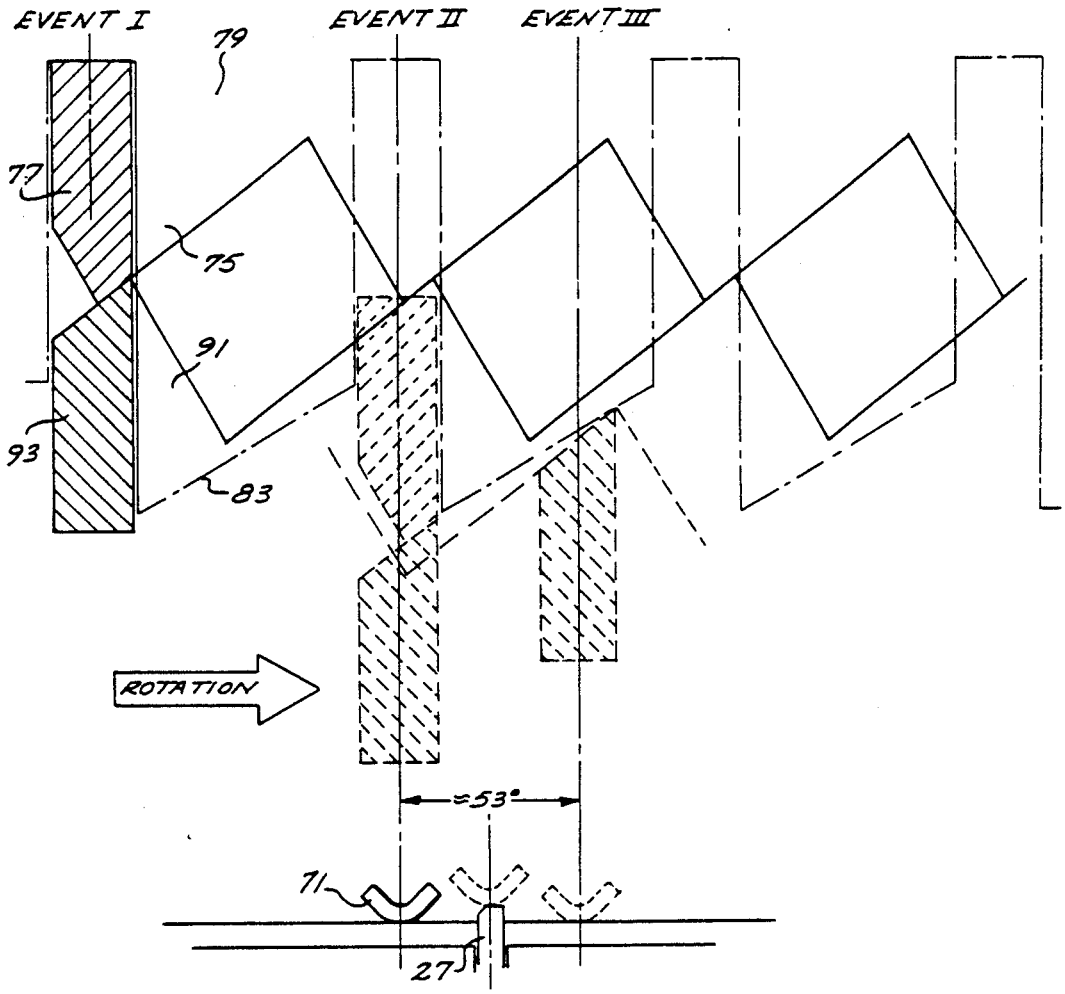
FIG. 10 is a schematic representation of the ratchet mechanism during a switching cycle.
Figure 11:
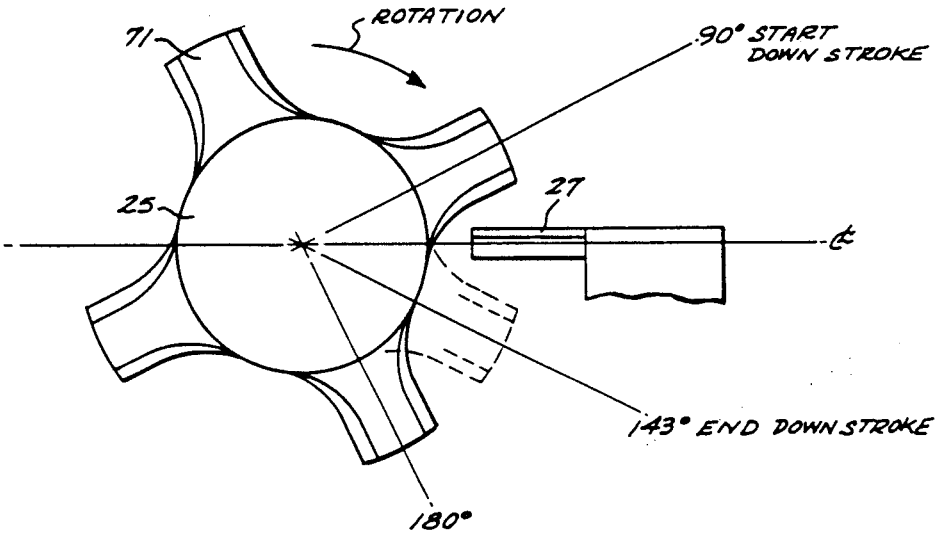
FIG. 11 is a top planar view of the contact cup of the pulse switch of the present invention.

The motion associated with a single cycle of actuation of the ratchet mechanism which includes the plunger 29 and the ratchet sleeve 39 in cooperation with the splines 79 will now be described as is illustrated in FIG. 10. The vertical splines 79 are separated by a portion of the interior wall creating the space which can accommodate plunger and ratchet protuberances 77 and 93 respectively which extend radially outward from the respective components to which they are attached and are slidably received in the space between the splines 79. Each of the splines 79 includes the terminal end 83 which is formed into a wedge-shaped ramp at the lower extremity of the splines in a position level with the plunger protuberance 77 when the push button plunger 29 is in its depressed state.

Due to the bias of the main spring 23, the plunger 29 and the ratchet sleeve 39 are normally held in their most upward position (Event I, FIG. 10) wherein the plunger protuberances 77 engage the ratchet sleeve protuberances 93. Due to the previously described angular offset of the positions of the respective teeth relative to the respective protuberances, when both the protuberances 77 and the protuberances 93 reside between the splines 79, the plunger teeth 75 and the ratchet sleeve teeth 91 do not mesh as is apparent in FIG. 10 during Event I and II.

Once the protuberance 91 has been placed beyond the end 83 on the spline 79 (Event II), the ratchet sleeve 39, driven by the force of the main spring 23, is free to rotate and close the gap between teeth 75 and 91 as is illustrated in FIG. 10, Event III. This rotation occurs while the plunger 29 is fully depressed as the movement is driven by the expansion of the compressed main spring 23. Upon release, the push button plunger 29 retracts through the vertical upper section of the body portion 31 driven by the energy stored in the main spring 23. Concurrently, the plunger protuberances 77 correspondingly retract upwardly into the space between the splines.

As the plunger protuberances 77 recede into the space, the ratchet sleeve 39, driven by the force of the main spring 23, attempts to follow. However, the camming action of the protuberance 93 on the terminal end 83 of the spline forces the protuberance 93 to rotate further into the adjacent space. As the ratchet sleeve protuberance 93 slides up the ramp-shaped terminal end 83 and up the adjacent space, the ratchet sleeve 39 is caused to rotate in the direction urged by the ramp-shaped terminal end.

Because the vertical grooves 87 of the contact cup 25 receive the vertical ribs 83 of the ratchet sleeve 39, the contact cup is carried with the rotating ratchet sleeve 39. As the contact cup 25 is rotated, the plurality of extension ears 71 rotate therewith.

The fact that there are a total of four splines spaced about the interior of the vertical section of the body portion results in 90° of rotation with each switching cycle. The extension ears of the contact cup 25 are positioned such that one extension ear 71 sweeps across the stationary contact 27 while the ratchet mechanism proceeds from Event II to Event III. It has been found that selection of protuberance 77, 93 positions, teeth 75, 91 positions, contact cup 25 positions and stationary contact 27 position selected such that a rotation of about 53° results upon depression of the plunger 29 is preferred, contact of an extension ear 71 with the contact 27 being made at the appropriate midpoint of this rotation, i.e. approximately 26.5°.

The curved form of the extension ear insures that each extension ear properly engages the contact 27, easily slides thereover, and only makes contact for a very brief instant of time. During that instance, electricity flows through the first conductor 41, the first electrical connector 53 up to its ring portion 61, through the conductor spring 73, contact cup 25, extension ear 71, stationary contact 27, the second electrical connector 55 and on to the second electrical conductor 43.

From the foregoing, it will be appreciated that the miniature push button ratchet switch of the present invention when installed within an electric circuit produces a single pulse upon depression of the plunger. In addition, the time during which the circuit is closed remains constant regardless of how quickly the plunger is depressed or how long it is held down.

While several particular forms of the invention have been illustrated and described, it will be apparent that various modifications can be made without departing from the spirit and scope of the invention. Accordingly, it is not intended that the invention be limited, except as by the appended claims.

What is claimed is:

1. A miniature switching apparatus for closing an electrical circuit for a brief period of time, comprising:

a housing;

a first electrical contact positioned within said housing;

a second electrical contact positioned within said housing;

interconnecting means rotatably mounted within said housing for interconnecting said first electrical contact and said second electrical contact during a preselected rotational orientation;

an actuation element slideably mounted within and projecting from said housing, said actuation element having a compression stroke and a return stroke; and operating means, coupled to said actuation element during said compression stroke and decoupled from said actuation element during the return stroke, for converting depression of said actuation element into a rotation of said interconnecting means from a position before to a position after said preselected rotational orientation.

2. The miniature switching apparatus of claim 1 wherein said operating means comprises a ratchet mechanism.

3. The miniature switching apparatus of claim 2 wherein said actuation element comprises a push button.

4. The miniature switching apparatus of claim 3 wherein said interconnecting means comprises a metallic cup including a flared portion having radially extending tabs and further comprising a metallic conductor spring wherein said spring conductor electrically connects said first electrical contact with said metallic cup and each of said tabs engages said second electrical contact during a preselected rotational orientation of said metallic cup.

5. The miniature switching apparatus of claim 4 wherein said operating means further includes a main spring which is compressed by depression of said actuation element and which drives the rotation of said interconnecting means by its expansion.

6. The miniature switching apparatus of claim 5 wherein said operating means freely allows said main spring to expand upon depression of said actuation element beyond a preselected position.

7. The miniature switching apparatus of claim 6 wherein said flared end of said metallic cup has four radially extending tabs and said operating means converts depression of said actuation element into 90° of rotation of said metallic cup.

8. The miniature switching apparatus of claim 7 wherein one of said tabs engage said second electrical contact at approximately 25°-28° of rotation.

9. Switching apparatus comprising:

a housing;

a first electrical contact positioned within said housing;

a second electrical contact positioned within said housing;

interconnecting means rotatably mounted within said housing for interconnecting said first electrical contact and said second electrical contact during a preselected rotational orientation, and wherein said interconnecting means comprises a metallic cup including a flared portion having radially extending tabs and further comprising a metallic spring wherein said spring electrically connects said first electrical contact with said metallic cup and each of said tabs engages said second electrical contact during a preselected rotational orientation of said metallic cup;

a push button slideably mounted within and projecting from said housing; and operating means for converting depression of said push button to a rotation of said interconnecting means from a position before to a position after said preselected rotational orientation.

10. The switching apparatus of claim 9 wherein said operating means further includes a main spring which is compressible by depression of said push button and which drives the rotation of said interconnecting means by its expansion.

11. The switching apparatus of claim 10 wherein said operating means freely allows said main spring to expand upon depression of said push button beyond a preselected position.

12. The switching apparatus of claim 11 wherein said flared end of said metallic cup has four radially tabs and said operating means converts depression of said push button into 90° of rotation of said metallic cup.

13. The switching apparatus of claim 12 wherein one of said tabs engage said second electrical contact at approximately 25°-28° of rotation.

* * * * *